US005748510A

United States Patent [19]

Shou et al.

[11] Patent Number: 5,748,510

[45] Date of Patent: May 5, 1998

[54] MULTIPLICATION CIRCUIT WITH SERIALLY CONNECTED CAPACITIVE COUPLINGS

[75] Inventors: Guoliang Shou; Kazunori Motohashi; Makoto Yamamoto; Sunao Takatori, all of Tokyo, Japan

[73] Assignees: Yozan Inc., Tokyo; Sharp Kabushiki Kaisha, Osaka, both of Japan

[21] Appl. No.: 536,244

[22] Filed: Sep. 29, 1995

[30] Foreign Application Priority Data

Sep. 30, 1994 [JP] Japan ..... 6-261615
Aug. 9, 1995 [JP] Japan ..... 7-224714

[51] Int. Cl.[6] ..... G06J 1/00

[52] U.S. Cl. ..... 364/606

[58] Field of Search ..... 364/602, 606; 341/133, 136, 144

[56] References Cited

U.S. PATENT DOCUMENTS 4,126,852 11/1978 Baertsch .
4,475,170 10/1984 Haque ..... 364/606
4,654,815 3/1987 Marin et al. .
4,896,284 1/1990 Takeuchi et al. ..... 364/606
5,361,219 11/1994 Shou et al. .
5,381,352 1/1995 Shou et al. .

FOREIGN PATENT DOCUMENTS 6-195483 7/1994 Japan .
6-215164 8/1994 Japan .

*Primary Examiner*—Tan V. Mai
*Attorney, Agent, or Firm*—Cushman, Darby & Cushman IP Group of Pillsbury, Madison & Sutro LLP

[57] ABSTRACT

A multiplication circuit includes a plurality of switches which receive a common analog input voltage and a reference voltage and which alternatively output the input voltage or the reference voltage. A first capacitive coupling is provided which has a plurality of capacitors, each of which receives an output from a respective switch, and a second capacitive coupling is provided with a plurality of capacitors, each of which likewise receives an output from a respective switch. One or more of the capacitors in the first capacitive coupling is connected to the second capacitive coupling. A first inverted amplifier and a second inverted amplifier are connected in series to the output of the second capacitive coupling with individual feedback.

2 Claims, 2 Drawing Sheets

MULTIPLICATION CIRCUIT WITH SERIALLY CONNECTED CAPACITIVE COUPLINGS

FIELD OF THE INVENTION

The present invention relates to a multiplication circuit for multiplying an analog voltage by a multiplier so as to output an analog voltage as a multiplication result.

BACKGROUND OF THE INVENTION

The inventors of the present invention have proposed a multiplication circuit for analog voltage in Japanese Patent Application Hei No. 04-357672 and U.S. patent application Ser. No. 08/170,731. As shown in FIG. 2, this multiplication circuit includes a) a plurality of switches SW1 to SW8 to which an analog input voltage is input, b) a capacitive coupling CP for integrating outputs of the switches with weighting and c) a 2 stage inverted amplifier for stabilizing an output of the capacitive coupling. The capacitive coupling includes a plurality of capacitors with capacitances corresponding to weights of bits of a binary number, and the switches means are controlled by signals corresponding to bits of the multiplier.

In order to improve the resolution of the multiplier in the multiplication circuit, a lot of levels of capacitances are necessary for the capacitors in the capacitive coupling. In a large scale integrated circuit, a capacitor is usually formed by a plurality of unit capacitors connected in parallel, so a large number of unit capacitors are needed for the capacitors in the capacitive coupling. Thus, the circuit size becomes large.

SUMMARY OF THE INVENTION

The present invention solves the above problems and has an object to provide a multiplication circuit in which a multiplier of high resolution is easily defined without increasing the circuit size.

According to the present invention, a plurality of capacitive couplings are sequentially provided for defining a multiplier so that the weighting by the capacitive coupling is performed a plurality of times for one input voltage.

PREFERRED EMBODIMENTS OF THE INVENTION

Hereinafter, an embodiment of a multiplication circuit according to the present invention is described with referring to the attached drawings.

Figure 1:
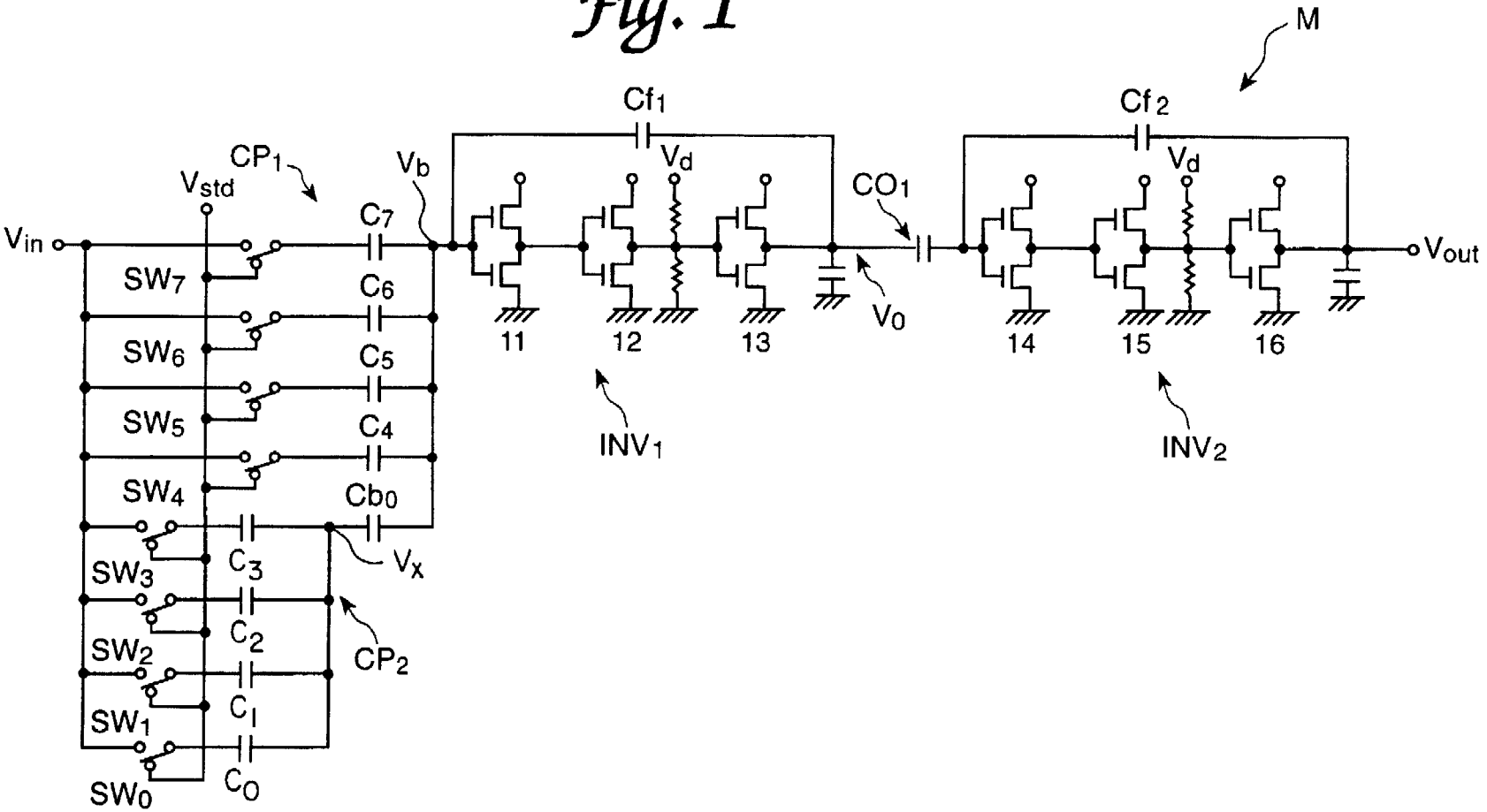
FIG. 1 is a circuit diagram of a multiplication circuit of the an embodiment according to the present invention.

In FIG. 1, a multiplication circuit M has sequential inverted amplifiers INV1 and INV2 of 2 stages to which feedback capacitances Cf1 and Cf2 are connected for feeding outputs of INV1 and INV2 back to inputs, respectively. A capacitive coupling CP1 with capacitors C4, C5, C6 and C7 is connected to an input terminal of INV1, and an analog input voltage Vin is commonly connected in parallel to each capacitor C4, C5, C6 and C7 through switch SW4, SW5, SW6 and SW7. A coupling capacitor C01 is connected to an input terminal of INV2 and the output of INV1 is connected to INV2 through C01.

Capacitors C7, C6, C5 and C4 of capacitive coupling CP1 have capacitances corresponding to weights of bits of a binary number of 4 bits, from MSB to LSB. These capacitances are shaped in a LSI (large scale integrated circuit) by a plurality of unit capacitors which is the minimum capacitor practically available in the LSI. When a capacitance of the unit capacitor is Cu, the capacitors are defined as follows.

C7=8Cu, C6=4Cu, C5=2Cu, C4=Cu.

The capacitive coupling CP1 further includes a capacitor Cb0 with a capacitance of Cu through which CP1 is connected to the second capacitive coupling CP2.

Capacitive coupling CP2 includes capacitors C3, C2, C1 and C0 which have capacitances equal to the weights of the binary bits from MSB to LSB. Here, the capacitors are defined as follows.

C3=8Cu, C2=4Cu, C1=2Cu, C0=Cu.

The input voltage Vin is connected to capacitors C3, C2, C1 and C0 through switches means SW3, SW2, SW1 and SW0.

INV1 and INV2 are composed of inverters I1, I2 and I3, and I4, I5 and I6 of 3 stages, respectively. INV1 and INV2 have a large gain given by a multiplication of open gains of the 3 staged inverters. Then, the outputs of INV1 and INV2 are stabilized inversion of the inputs of high accuracy.

The switches SW0 to SW7 alternatively outputs the input voltage Vin or a reference voltage Vstd so that Vin is switch when a bit corresponding to the switch is "1" and Vstd is output when the bit is "0".

The following formulas (1) and (2) are defined when the bits corresponding to SW0, SW1, SW3, SW4, SW5, SW6 and SW7 are b0, b1, b2, b3, b4, b5, b6 and b7, an output voltage of CP2 (input voltage of Cb0) is Vx, an output voltage of CP1 (input voltage of INV1) is Vb, an output voltage of INV1 (input voltage of C01) is Vo and an output voltage of INV2 is Vout.

$$Cf_1(Vo - Vb) + \sum_{i=4}^{7} Ci\,\{bi(Vin - Vb) + (1 - bi)(Vstd - Vb)\} + Cbo(Vx - Vb) = 0 \quad (1)$$

$$Cbo(Vb - Vx) + \sum_{i=0}^{3} Ci\{bi(Vin - Vx) + (1 - bi)(Vstd - Vx)\} = 0 \quad (2)$$

Vx in formula (1) is substituted by Vx introduced from the formula (2). Then, the following formula (3) is obtained.

$$Cf1(Vo - Vb) + \sum_{i=4}^{7} Ci\{biVin + (1 - bi)Vstd - Vb\} + \frac{Cbo}{\sum_{i=0}^{3} Ci + Cbo}\left[\sum_{i=0}^{3} Ci\{biVin + (1 - bi)Vstd\} + CboVb\right] - CboVb = 0 \quad (3)$$

Capacitors in CP1 and CP2 have capacitances shown in formula (4) and (5). The formula (3) is rewritten to be formula (6) according to the relationships of formula (4) and (5).

C7:C6:C5:C4:C3:C2:C1:C0:Cb0=8:4:2:1:8:4:2:1:1 (4)

$$Cf1 = \sum_{i=4}^{7} Ci + Cbo = 16Co \quad (5)$$

$$Vo - Vb = -\frac{1}{16^2}\left[\sum_{i=0}^{7} 2^i\{biVin + (1-bi)Vstd\} - 255Vb\right] \quad (6)$$

The above reference voltage Vstd is a voltage equal to Vd or to the ground voltage, and the output voltage Vo of INV1 is defined as in formulas 7 and 8 in response to the definition of Vstd.

i) When Vstd=Vb, then $$Vo - Vb = -\frac{1}{16^2}\sum_{i=0}^{7} 2^i bi(Vin - Vb) \quad (7)$$

ii) When Vstd=0, then $$Vo - Vb = -\frac{1}{16^2}\sum_{i=0}^{7} 2^i bi(Vin - Vb) \quad (8)$$

Furthermore, a formula of output Vout from INV2 is calculated in formula 9. Formulas 10 and 11 are obtained by inputting formulas 7 and 8 to formula 9.

$$Cf2(Vout - Vb) = -Co1(Vo - Vb),\ Cf2 = Co1 \quad (9)$$

$$Vout - Vb = \frac{1}{16^2}\sum_{i=0}^{7} 2^i b^i(Vin - Vb) \quad (10)$$

$$Vout = \frac{1}{16^2}\sum_{i=0}^{7} 2^i biVin + \frac{1}{16^2} Vb \quad (11)$$

Here, generally 2Vb=Vdd.

Figure 2:
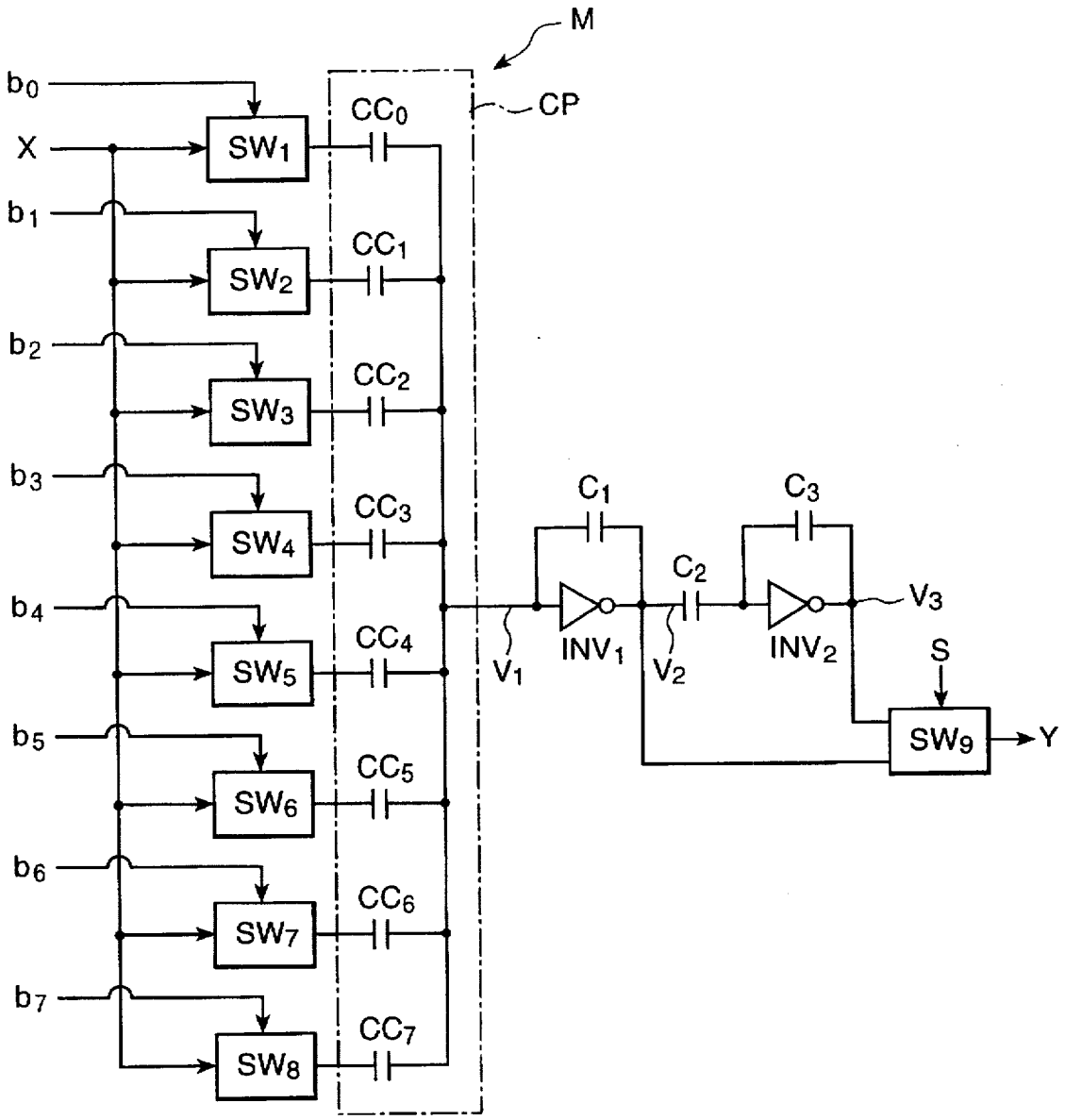
Fig. 2 (PRIOR ART)
FIG. 2 is a block diagram showing a conventional multiplication circuit.

It is a multiplication result of an analog input voltage Vin by a digital multiplier of 8 bits, and an offset of inverter circuits are negligible when the final output is measured based on the reference voltage Vstd. When 0[V] is a reference voltage, it is necessary to consider a minute offset term of a order of ($Vb/16^2$). In the circuit in FIG. 2, at least 256 unit capacitances are needed for the capacitive coupling much more than the above embodiment. The first embodiment uses only 32 units capacitances.

It is possible to realize multiplication of higher resolution by more stages of capacitive couplings than 2 stages.

As mentioned above, a plurality of capacitive couplings are sequentially provided for defining a multiplier so that the weighting by the capacitive coupling is performed a plurality of times for one input voltage, and a multiplication circuit in which a multiplier of high resolution is easily defined without increasing the circuit size.

What is claimed is:

1. A multiplication circuit, comprising:

a plurality of switches which receive a common analog input voltage and a reference voltage, and alternatively output one of the analog input voltage and the reference voltage;

a first capacitive coupling having a first plurality of capacitors, each of said first plurality of capacitors being connected to a respective one of said switches;

a second capacitive coupling having a second plurality of capacitors, each of said second plurality of capacitors being connected to a respective one of said switches; and a connecting capacitor, wherein one or more of said first capacitors in said first capacitive coupling is connected through said connecting capacitor to the second capacitive coupling.

2. A multiplication circuit as claimed in claim 1, wherein said second capacitive coupling is connected through said connecting capacitor to one of said capacitors corresponding to a least significant bit of the first capacitive coupling.

* * * * *